US011154751B2

(12) United States Patent
Bosch

(10) Patent No.: US 11,154,751 B2
(45) Date of Patent: Oct. 26, 2021

(54) EXERCISE APPARATUS

(71) Applicant: Greg Bosch, St. George, SC (US)

(72) Inventor: Greg Bosch, St. George, SC (US)

( * ) Notice: Subject to any disclaimer, the term of this patent is extended or adjusted under 35 U.S.C. 154(b) by 0 days.

(21) Appl. No.: 16/992,778

(22) Filed: Aug. 13, 2020

(65) Prior Publication Data

US 2021/0260438 A1 Aug. 26, 2021

Related U.S. Application Data

(60) Provisional application No. 62/979,090, filed on Feb. 20, 2020.

(51) Int. Cl.
*A63B 23/08* (2006.01)
*A63B 21/00* (2006.01)
(Continued)

(52) U.S. Cl.
CPC ..... *A63B 23/085* (2013.01); *A63B 21/0428* (2013.01); *A63B 21/154* (2013.01);
(Continued)

(58) Field of Classification Search
CPC ..... A63B 21/00058; A63B 21/00061; A63B 21/00065; A63B 21/00178; A63B 21/00181; A63B 21/00185; A63B 21/002; A63B 21/0023; A63B 21/02; A63B 21/04; A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/15; A63B 21/151; A63B 21/154; A63B 21/22; A63B 21/4027; A63B 21/4033; A63B 21/4034; A63B 21/4035; A63B 21/4039; A63B 21/4045; A63B 21/4047; A63B 21/4049; A63B 22/0046; A63B 22/14; A63B 22/18; A63B 2022/185; A63B 2023/003; A63B 23/0216; A63B 23/0222; A63B 23/035; A63B 23/03508; A63B 23/03516; A63B 23/03533; A63B 23/03541; A63B 23/04; A63B 23/0405;
(Continued)

(56) References Cited

U.S. PATENT DOCUMENTS 4,390,180 A * 6/1983 Simjian ..... A63B 22/14 482/131
4,515,363 A * 5/1985 Schleffendorf ..... A63B 21/155 482/100
(Continued)

*Primary Examiner* — Gary D Urbiel Goldner
(74) *Attorney, Agent, or Firm* — Tarter Krinsky & Drogin LLP

(57) ABSTRACT

Exemplary embodiments of an exercise apparatus are provided, both as a stationary and a portable unit, the exercise apparatus including a base frame, a base plate provided on the base frame, the base plate including a plurality of holes on a top surface of the base plate and configured to rotate with respect to the base frame, a foot plate provided on the base plate, the foot plate including a tapered pin on a bottom surface of the foot plate that can engage with one of the plurality of holes of the base plate, wherein when the tapered pin is engaged to one of the plurality of holes of the base plate, the foot plate and base plate are configured to rotate with respect to the base frame.

20 Claims, 15 Drawing Sheets

(51) Int. Cl.
*A63B 23/02* (2006.01)
*A63B 23/035* (2006.01)
*A63B 21/04* (2006.01)

(52) U.S. Cl.
CPC ..... *A63B 21/4034* (2015.10); *A63B 21/4035* (2015.10); *A63B 23/0216* (2013.01); *A63B 23/03533* (2013.01); *A63B 2208/0204* (2013.01); *A63B 2208/0233* (2013.01)

(58) Field of Classification Search
CPC ... A63B 23/0482; A63B 23/08; A63B 23/085; A63B 69/0057; A63B 69/0062; A63B 71/0054; A63B 2071/0063; A63B 2071/0072; A63B 2208/0204; A63B 2208/0228; A63B 2208/0233
See application file for complete search history.

(56) References Cited

U.S. PATENT DOCUMENTS 5,102,121 A * 4/1992 Solow ..... A63B 21/155 482/137
5,368,535 A * 11/1994 Twardokens ..... A63B 21/151 482/100
5,632,711 A * 5/1997 Hwang ..... A63B 22/14 482/146
5,722,921 A * 3/1998 Simonson ..... A63B 21/155 482/100
5,941,807 A * 8/1999 Cassidy ..... A63B 22/14 482/130
7,081,074 B1 * 7/2006 Rubin ..... A63B 22/14 482/146
7,278,956 B1 * 10/2007 Chen ..... A63B 22/0087 472/21
7,396,319 B1 * 7/2008 Ellis ..... A63B 21/155 482/100
7,604,576 B2 * 10/2009 Drechsler ..... A63B 21/154 482/100
7,909,747 B1 * 3/2011 LaCaze ..... A63B 21/4009 482/142
9,295,873 B1 * 3/2016 LaCaze ..... A63B 21/0435
9,393,458 B1 * 7/2016 LaCaze ..... A63B 23/085
9,446,288 B1 * 9/2016 Pazan ..... A61H 1/0285
10,549,152 B2 * 2/2020 Walker ..... A63B 21/4049
10,737,139 B2 * 8/2020 Walker ..... A63B 21/4049
2011/0028870 A1 * 2/2011 Greenburg ..... A63B 21/062 601/27
2011/0287914 A1 * 11/2011 Morris ..... A63B 21/015 482/147
2012/0143101 A1 * 6/2012 Schmidt ..... A63B 21/4015 601/5
2013/0085048 A1 * 4/2013 Na ..... A63B 21/4049 482/142
2016/0074702 A1 * 3/2016 MacDonald ..... A63B 21/225 482/147
2016/0236025 A1 * 8/2016 Henan ..... A63B 23/03508
2016/0263424 A1 * 9/2016 LaCaze ..... A63B 21/4035
2016/0279459 A1 * 9/2016 Walker ..... A63B 23/1209
2017/0340918 A1 * 11/2017 Walker ..... A63B 21/4049
2018/0117384 A1 * 5/2018 Endelman ..... A63B 21/0435
2018/0361200 A1 * 12/2018 Walker ..... A63B 21/4034
2019/0290967 A1 * 9/2019 Huber ..... A63B 21/4035

* cited by examiner

EXCERCISE 3

EXCERCISE 4

EXCERCISE 5

EXCERCISE 6

EXERCISE APPARATUS

CROSS-REFERENCE TO RELATED APPLICATIONS

This application relates to and claims priority from U.S. Provisional patent Application Ser. No. 62/979,090 filed Feb. 20, 2020, the entire disclosure of which is hereby incorporated herein by reference.

FIELD OF THE DISCLOSURE

The present disclosure relates to exemplary embodiments of an exercise apparatus, and more particularly, to exemplary embodiments of an exercise apparatus used for training and rehabilitation exercises.

BACKGROUND INFORMATION

Various exercise apparatuses are provided for weight and strength training. The exemplary embodiments of the present disclosure can provide for an exercise apparatus that can be used by a user or trainer for isokinetic evaluation, testing, training and rehabilitation.

SUMMARY OF EXEMPLARY EMBODIMENTS OF THE DISCLOSURE

Exemplary embodiments of the present disclosure can provide for an exercise apparatus comprising a base frame, a base plate provided on the base frame, the base plate including a plurality of holes on a top surface of the base plate and configured to rotate with respect to the base frame, a foot plate provided on the base plate, the foot plate including a tapered pin on a bottom surface of the foot plate that can engage with one of the plurality of holes of the base plate, wherein when the tapered pin is engaged to one of the plurality of holes of the base plate, the foot plate and base plate are configured to rotate with respect to the base frame. The exercise apparatus can further comprise a plate angle indicator provided on the base frame that provides an angle that the foot plate and base plate are rotated with respect to the base frame.

In some exemplary embodiments, the exercise apparatus can further comprise a first support plate provided on the foot plate and having a first wall extending upward from the base plate, and a second support plate provided on the foot plate and having a second wall extending upward from the base plate, wherein a user's foot can be placed between the first wall and the second wall. In some exemplary embodiments, the first support plate and the second support plate can include slots. The exercise apparatus can further comprise one or more threaded knobs provided through the slots to secure the first support plate and second support plate to the foot plate. The exercise apparatus can further comprise padding secured to an inner portion of the first wall and the second wall.

In some exemplary embodiments, the exercise apparatus can further comprise a rod secured to a bottom surface of the foot plate and secured to the base frame, wherein the rod passes through the base plate and allows the foot plate to rotate with respect to the base frame. In some exemplary embodiments, the tapered pin can be tapered at an angle of approximately three degrees.

In some exemplary embodiments, the exercise apparatus can further comprise a resistance system connected to the base plate to provide resistance to the base plate and foot plate when rotated with respect to the base frame. The resistance system can comprise one or more resistance tubes. In some exemplary embodiments, the exercise apparatus can further comprise a twist bar secured to a pole extending upward from the base frame and having two handles that connect to the resistance system. In some exemplary embodiments, the exercise apparatus can further comprise a pulley system connected to the exercise apparatus and the resistance system.

In some exemplary embodiments, when a user lifts his foot when placed on the foot plate, the foot plate is configured to disengage from the base plate and the user can rotate the foot plate with respect to the base plate. In some exemplary embodiments, the exercise apparatus can further comprise a knee support connected to the exercise apparatus for providing support for the knees when using the exercise apparatus. The exercise apparatus can further comprise a handle connected underneath the base frame for providing portability of the exercise apparatus.

In some exemplary embodiments, the plurality of holes comprise eight holes provided equidistant from each other on a surface of the base plate. In some exemplary embodiments, the exercise apparatus can further comprise one or more eyelets connected to the base frame for connecting a first end of one or more resistance tubes to the base plate. The exercise apparatus can further comprise one or more pins provided on the base plate for connecting a second end of the one or more resistance tubes. In some exemplary embodiments, the base plate and foot plate can be rotated clockwise or counterclockwise with respect to the base frame.

In some exemplary embodiments, the exercise apparatus can further comprise a second base plate provided on and secured to the base frame, the second base plate including a plurality of holes on a top surface of the second base plate and configured to rotate with respect to the base frame, a second foot plate provided on the second base plate, the second foot plate including a tapered pin on a bottom surface of the second foot plate that can engage with one of the plurality of holes of the second base plate, wherein when the tapered pin is engaged to one of the plurality of holes of the second base plate, the second foot plate and the second base plate are configured to rotate with respect to the base frame.

BRIEF DESCRIPTION OF THE DRAWINGS

The foregoing and other objects of the present disclosure will be apparent upon consideration of the following detailed description, taken in conjunction with the accompanying drawings, and claims, in which like reference characters refer to like parts throughout, and in which:

Figure 1:
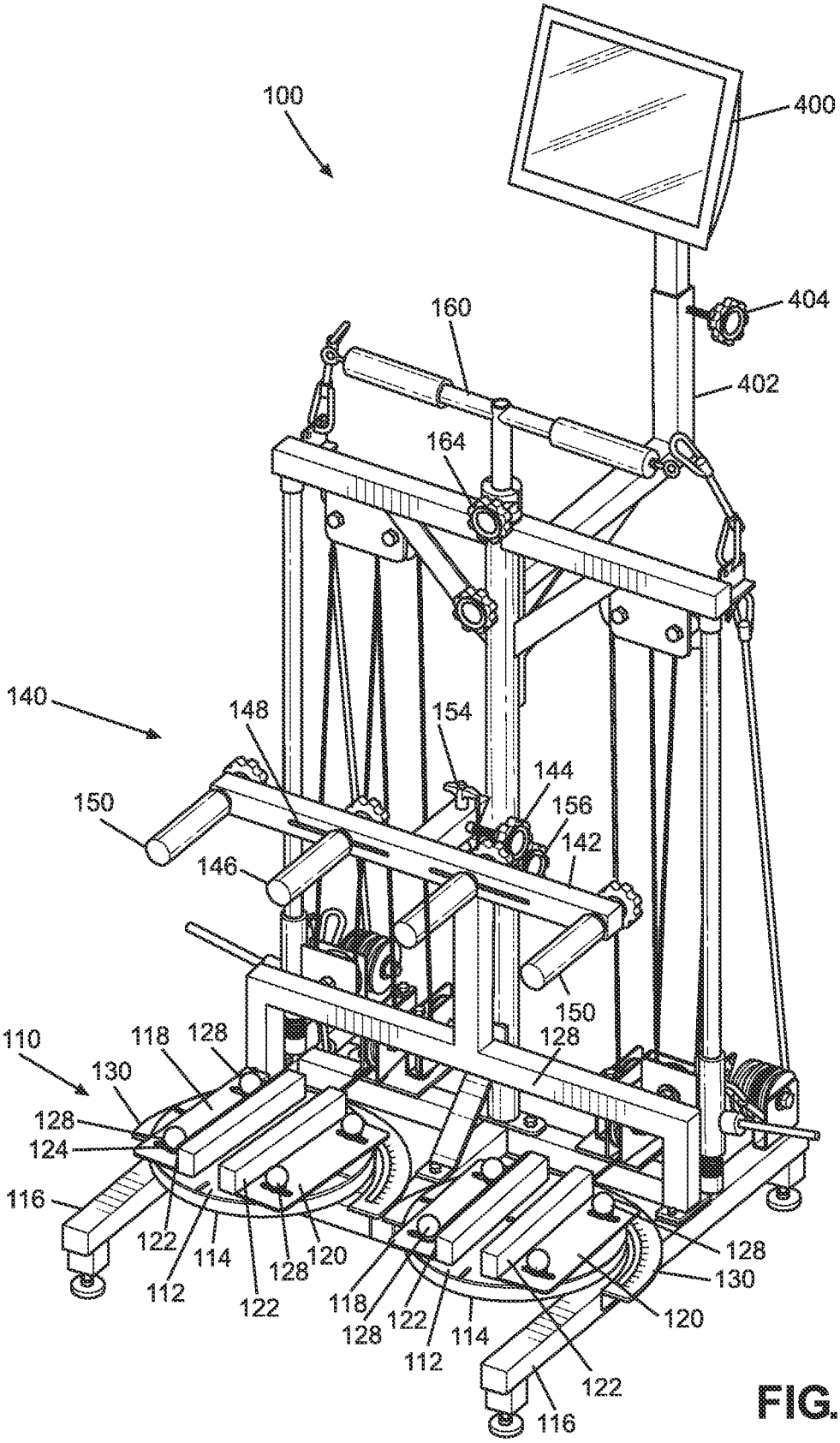
FIG. 1 is a front perspective view of an exercise apparatus according to an exemplary embodiment of the present disclosure.

Throughout the figures, the same reference numerals and characters, unless otherwise stated, are used to denote like features, elements, components or portions of the illustrated embodiments. Moreover, while the subject disclosure will now be described in detail with reference to the figures, it is done so in connection with the illustrative embodiments. It is intended that changes and modifications can be made to the described embodiments without departing from the true scope and spirit of the subject disclosure.

DETAILED DESCRIPTION OF EXEMPLARY EMBODIMENTS OF DISCLOSURE

The exemplary embodiments of the present disclosure can provide for an exercise apparatus that can be used by a user, as well as a therapist or trainer in assisting, testing, evaluating and training the user. The exercise apparatus can be used for sports training for isokinetic evaluation, testing, training and rehabilitation.

Exemplary embodiments of the various methods and apparatuses will now be described with reference to the figures. The following description of the various embodiments is merely exemplary in nature and is in no way intended to limit the scope of the disclosure, its application, or uses.

Figure 2:
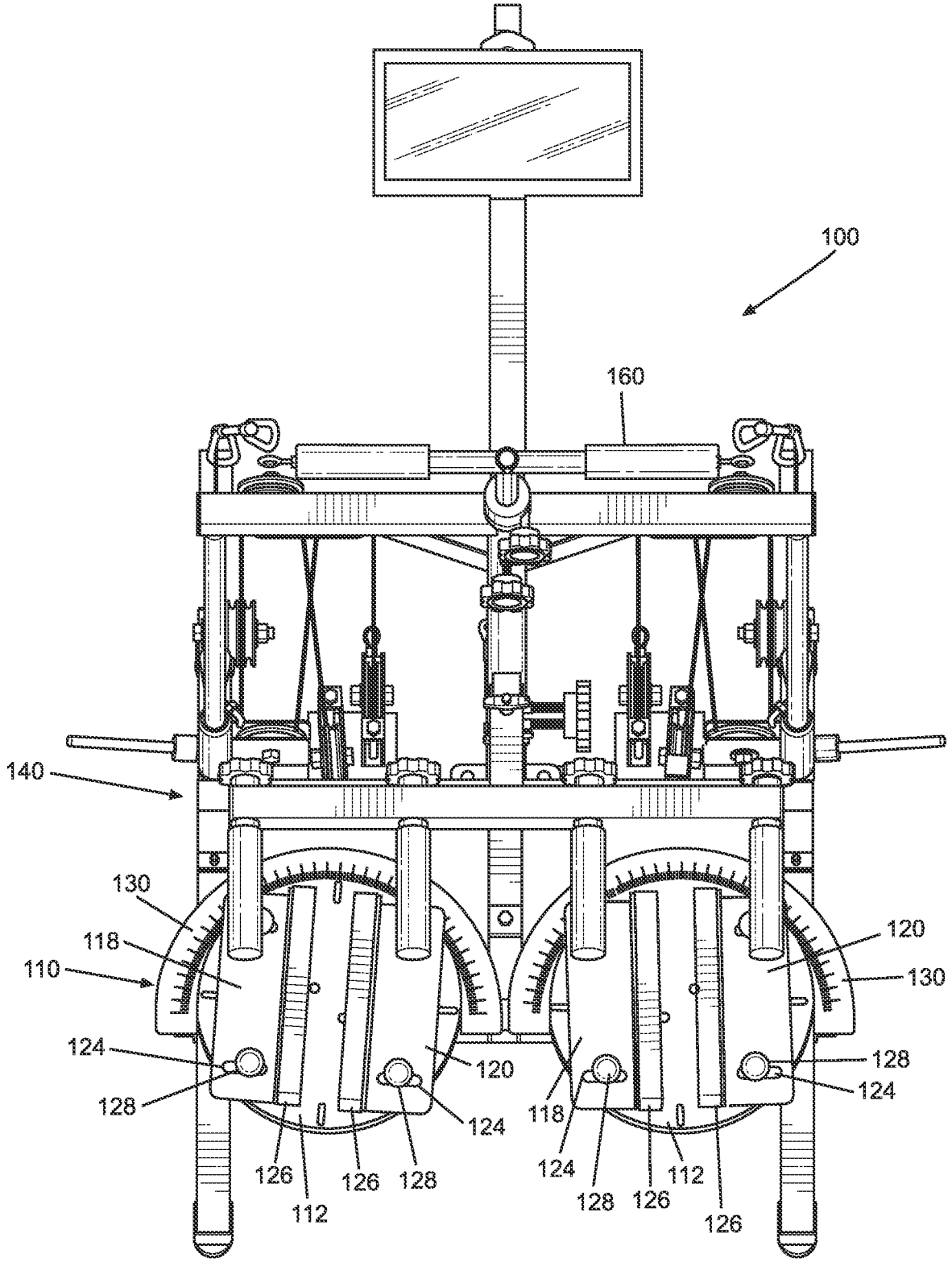
FIG. 2 is a top view of an exercise apparatus according to an exemplary embodiment of the present disclosure.
Figure 3A:
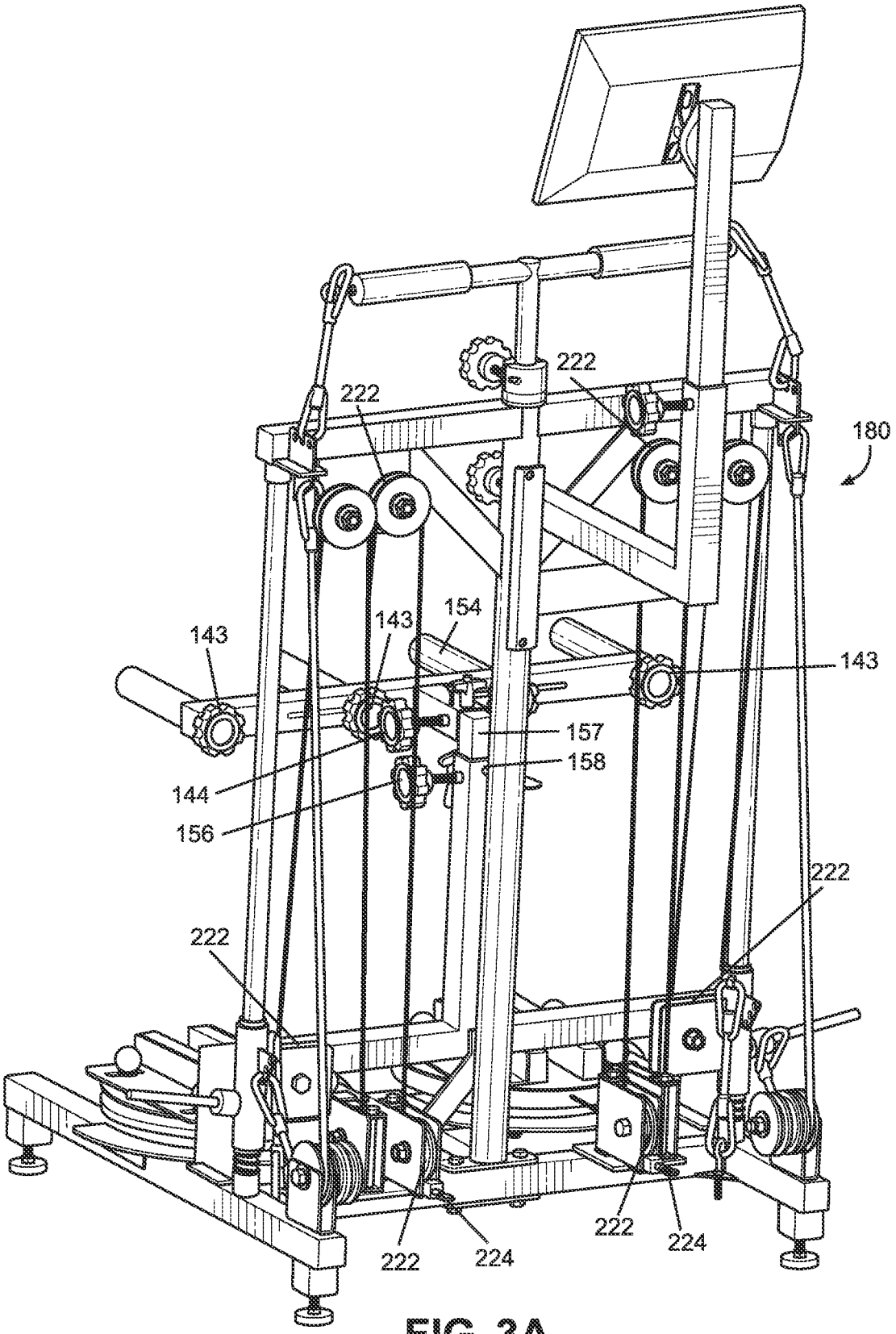
FIG. 3A is a rear perspective view of an exercise apparatus according to an exemplary embodiment of the present disclosure.
Figure 3B:
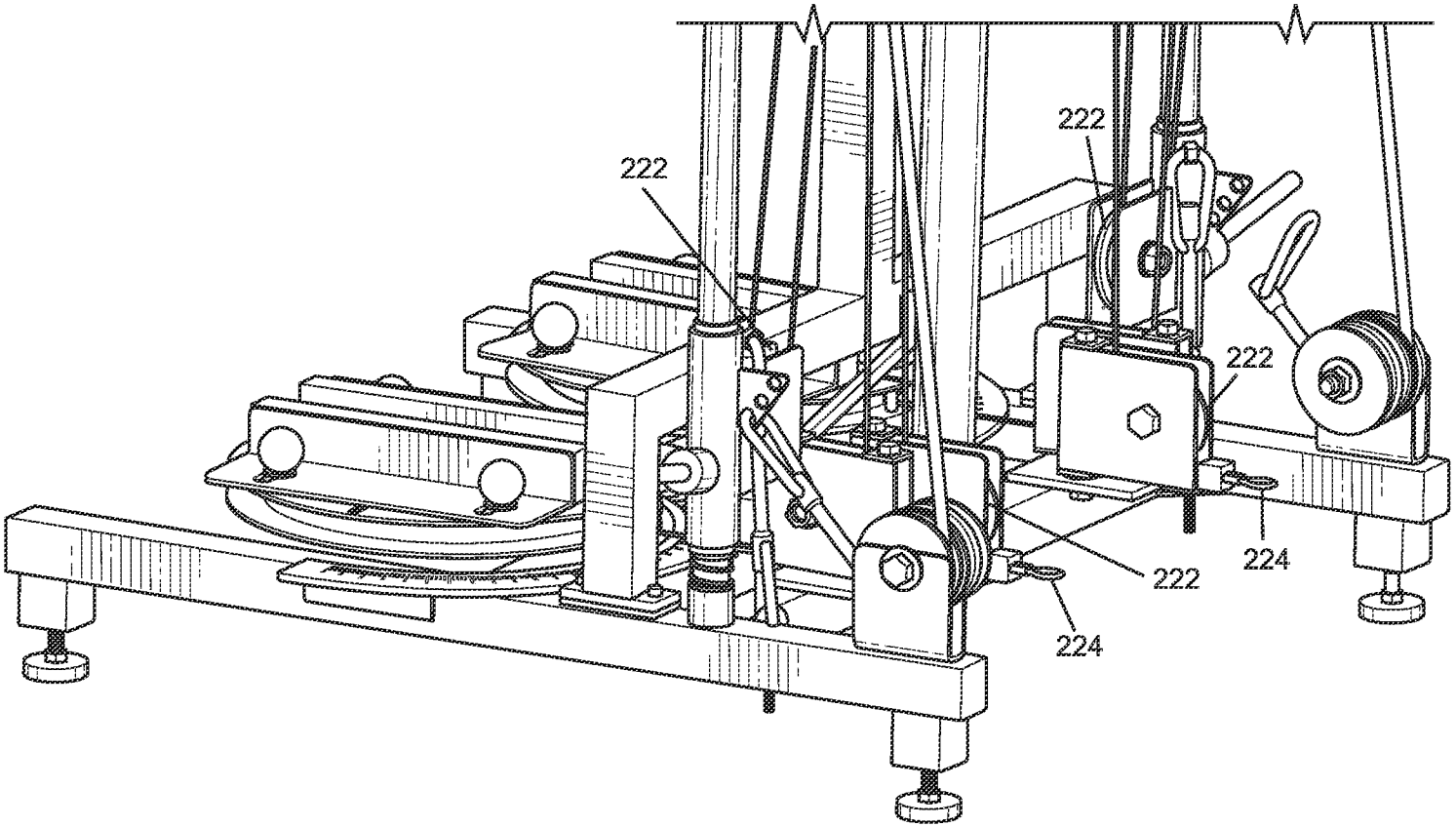
FIG. 3B is a portion of a rear perspective view of an exercise apparatus according to an exemplary embodiment of the present disclosure.

FIGS. 1-3(*b*) are illustrations of an exercise apparatus 100 according to the exemplary embodiments of the present disclosure. The exercise apparatus 100 comprises a foot plate system 110, a knee support 140 and a twist bar 160 at a front portion of the exercise apparatus 100, and a back pulley system 180 at a rear portion of the exercise apparatus 100 (as shown in FIG. 3A).

The foot plate system 110 comprises two foot plates 112, which can be but are not limited to a circular shape. Each foot plate 112 is provided on top of and secured to a base plate 114, such that the foot plate 112 can rotate with respect to the base frame 116, as will be further described below.

A left support plate 118 and a right support plate 120 are provided on top of each foot plate 112. The left support plate 118 and right support plate 120 have a vertically extending wall 122. The left support plate 118 and right support plate 120 can have one or more slots 124 through which threaded knobs 128 secure the left support plate 118 and right support plate 120 to the foot plate 112. The left support plate 118 and right support plate 120 can be but are not limited to a rectangular shape and can protrude at the corners over the foot plates 112. Two vertically extending walls 122 are provided on each of the left support plate 118 and right support plate 120, such that a user's foot can be placed between the vertically extending walls 122 of the left support plate 118 and right support plate 120.

The slots 124 allow the left support plate 118 and right support plate 120 to be adjustable along the base plates 112 to accommodate various widths of users' feet. In some exemplary embodiments, padding 126 such as foam can be provided inward of the vertically extending walls 122 such that a user can place his foot between the padding 126 of the vertically extending walls 122 of the left support plate 118 and the right support plate 120. When a user turns his foot on the foot plate 112, the foot plate 112, left support plate 118, right support plate 120 and base plate 114 all turn in the same direction with respect to the base frame 116.

Figure 5:
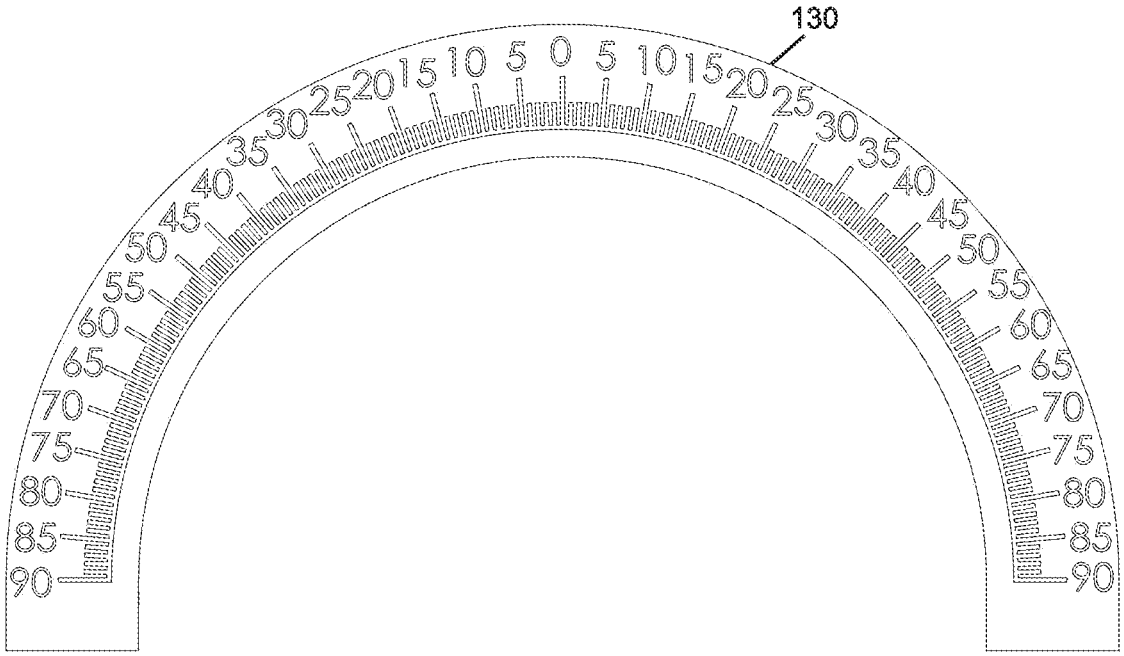
FIG. 5 illustrates a plate angle indicator of the exercise apparatus according to an exemplary embodiment of the present disclosure.

In some exemplary embodiments, a plate angle indicator 130 can be provided on the base frame 116 such that angle measurements are visible at a top portion of each foot plate 112. The plate angle indicator 130 can have but is not limited to a semi-circle shape that extends around a top half circumference of the foot plate 112, as shown in FIGS. 2 and 5. The plate angle indicator can range from 0-90 degrees on both the right and left sides. A top center part of the plate angle indicator 130 can be marked to "0" degrees, and each degree marked accordingly in a clockwise and counterclockwise direction. A needle or indicator line (not shown) can be provided on a top center portion of the foot plate 112 so a user can determine what degree the foot plate 112 is set on with respect to the plate angle indicator 130.

In some exemplary embodiments, the plate angle indicator can be provided surrounding the entire foot plate 112 and base plate 114, showing 360 degrees. The plate angle indicator 130 can allow a user (or therapist and user) to measure a user's range of motion. As the subject moves, the therapist can document at what degree compensations occur such as toes curling downward, a foot that supinates, toes dorsi flexing or fore foot pronation. This process of identifying compensations can help the therapist in the right direction in a rehabilitation process.

A locking mechanism is provided between the foot plate 112 and base plate 114 such that a user can lift the foot plate 112 off of the base plate 114, and turn the foot plate 112 to a desired degree (e.g., 10 degrees) on the plate angle indicator 130. Then, the user can release the foot plate 112, which would then lock the foot plate 112 to the base plate 114 at that location on the base frame 116. In some exemplary embodiments, a strap (not shown) can be provided over the padding 126 and connected between the left support plate 118 and right support plate 120 to allow a user to pick up his foot and lift the foot plate 112 from the base plate 114.

Figure 6A:
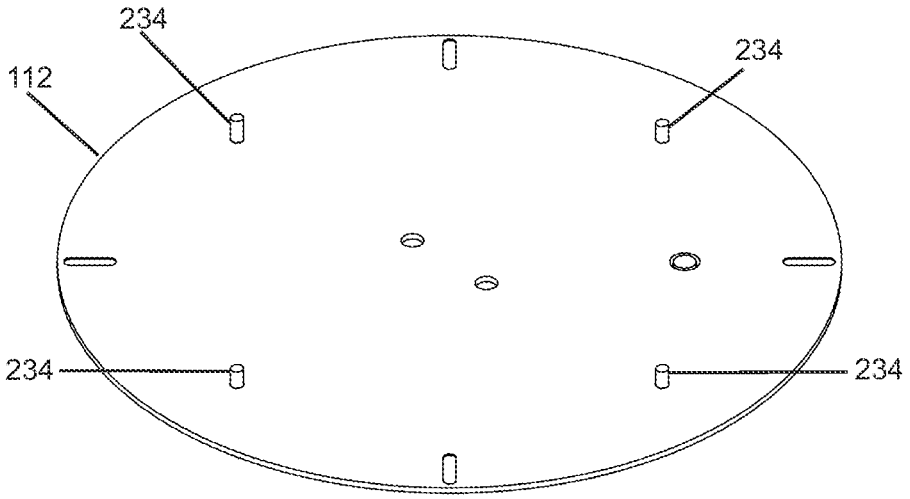
FIG. 6*a* illustrates a top view of a foot plate of the exercise apparatus according to an exemplary embodiment of the present disclosure.
Figure 6B:
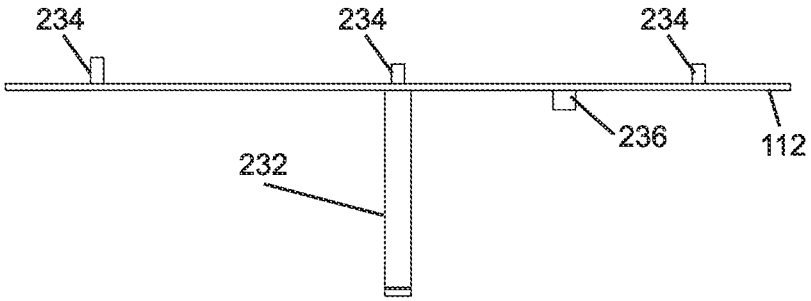
FIG. 6*b* illustrates a side view of a foot plate of the exercise apparatus according to an exemplary embodiment of the present disclosure.
Figure 6C:
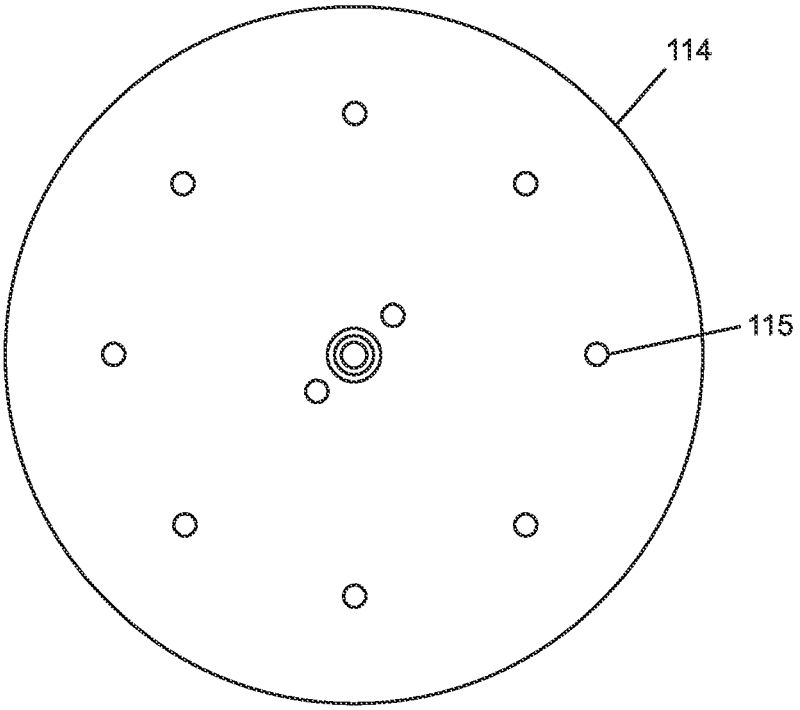
FIG. 6*c* illustrates a top view of a base plate of the exercise apparatus according to an exemplary embodiment of the present disclosure.

In some exemplary embodiments, the foot plate 112 can be locked at 45 degree intervals in the clockwise and counterclockwise direction on the base plate 114. As shown in FIGS. 6(*a*)-6(*c*), the foot plate 112 includes a rod 232 that is secured to a bottom center of the foot plate 112. The rod 232 is inserted through a circular hole at a center of the base plate 114 and placed through a circular hole in the base frame 116 to secure the base plate 114 and the foot plate 112 to the base frame 116. The bottom portion of the foot plate 112 has a tapered pin 236 that corresponds to a hole (not shown) in the base plate 114 to secure the foot plate 112 to the base plate 114.

Eight holes 115 are provided on the surface of the base plate 114 at an equal distance from each other that correspond to a desired position of the tapered pin 236, such that a user can lift the foot plate 112 off the base plate 114 to release the tapered pin 236 from the base plate 114. Then, the user can rotate the foot plate 112 at any 45 degree interval and place the tapered pin 236 into one of the eight holes 115 on the base plate 114, to lock and secure the foot plate 112 onto the base plate 114. More or less holes 115 can be provided on the base plate 114 to provide more positions of the foot plate 112 on the base plate 114 (e.g., 12 holes at 30 degree intervals), and the exemplary embodiments are not limited by any number of holes on the base plate 114.

The tapered pin 236 has a slight taper at an approximately 3 degree angle from the point it is secured to the foot plate 112 downward. The angle can range from 1 degree to 5 degrees. This provides less slack on the exercise apparatus 100 when doing various exercises such as terminal flicks (fast and quick movements). The corresponding holes on the base plate 114 can be cut on a chamfer machine allowing for a secure connection of the hole with the tapered pin 236. The top of the foot plate 112 has threaded rods 234 spaced equally apart on which the support plates 118 and 120 are provided on top of the slots 124, as described above. The threaded knobs 128 are then secured to the threaded rods 234.

Figure 4A:
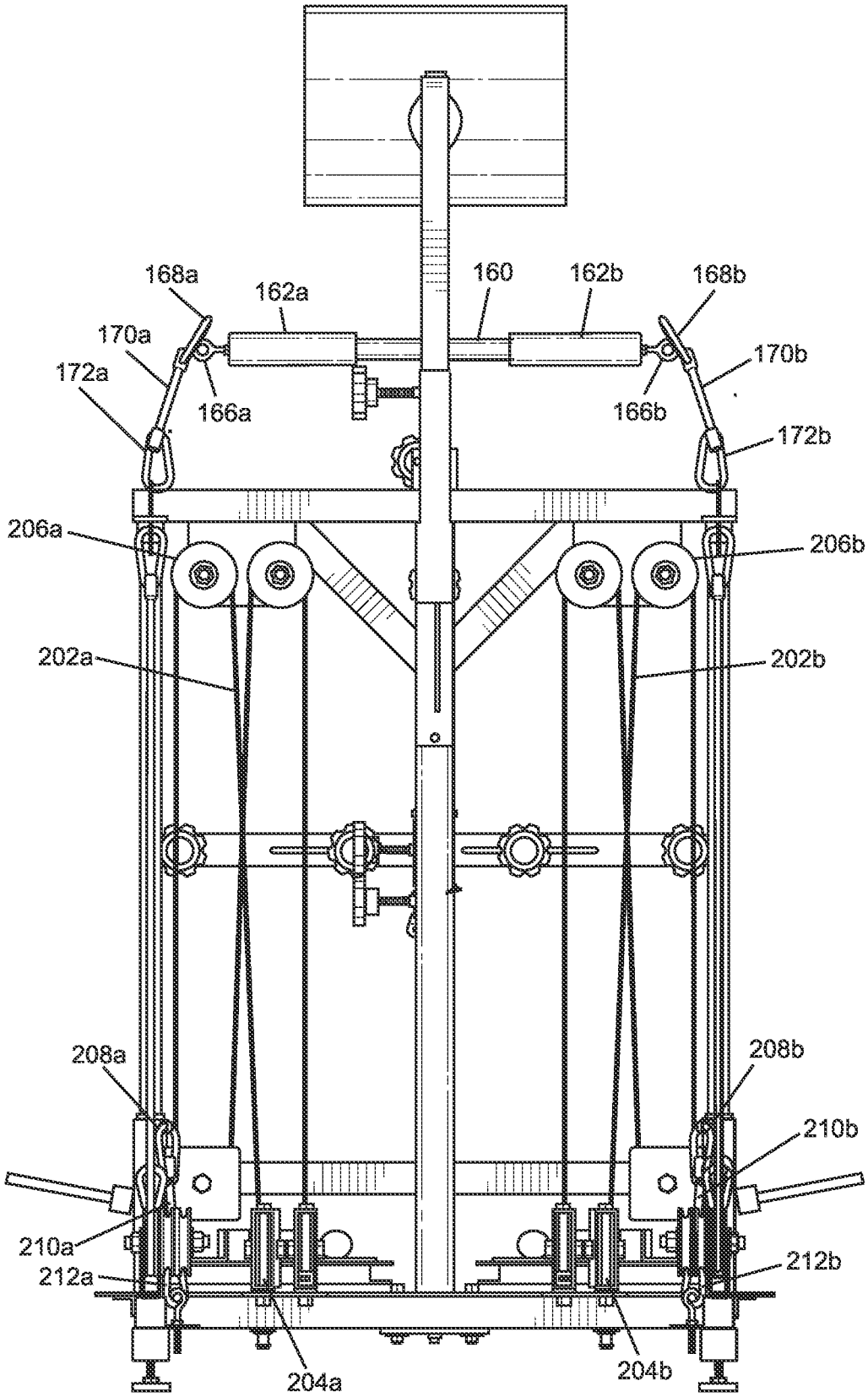
FIG. 4A is a rear view of an exercise apparatus according to an exemplary embodiment of the present disclosure.
Figure 4B:
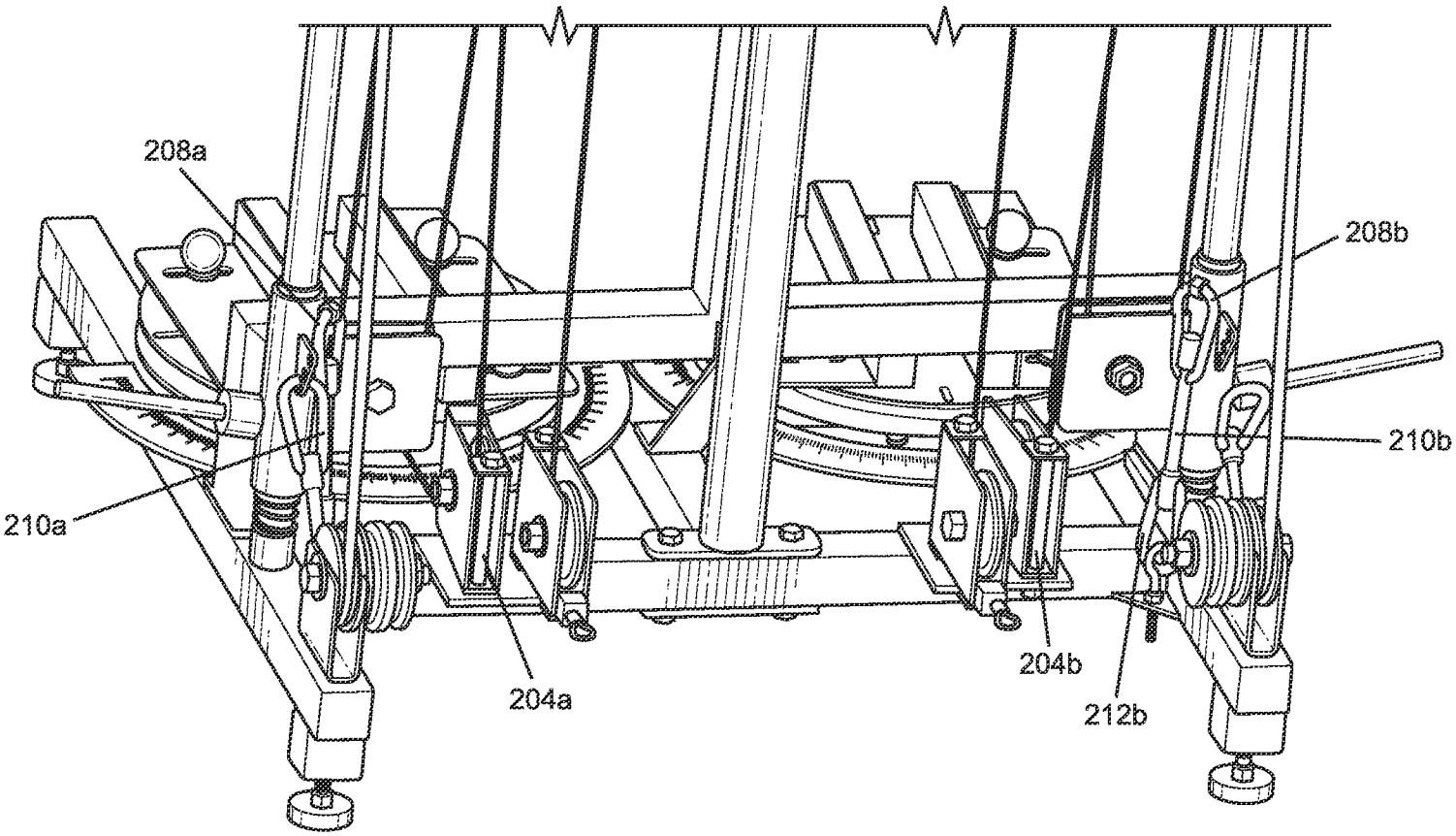
FIG. 4B is a portion of a rear perspective view of an exercise apparatus according to an exemplary embodiment of the present disclosure.

Various resistance can be provided using the foot plate system 110. As shown in FIGS. 4*a* and 4*b*, cable wires 202*a*, 202*b* can be connected to the foot plates 112. The cable wires 202*a*, 202*b* are each connected at one end to one of the foot plates 112, through pulleys 204*a*, 204*b* and upward to pulleys 206*a*, 206*b*, and then downward to a second end connected to clips 208*a*, 208*b*. Clips 208*a*, 208*b* can be connected to resistance tubing 210*a*, 210*b* (e.g., Cando® tubing), which is connected at a second end to clips 212*a*, 212*b*. The resistance tubing can be changed as needed to provide different resistances and strengths depending on the user and the exercise.

An example of how a person would use the foot plate system 110 would be to lift up the foot plate 112 from the base frame 116, move the indicator line on the foot plate 112 clockwise until the 45 degrees mark on the plate angle indicator 130, and then release and lock the foot plate 112 on the base plate 114 at that location. The therapist can then assess range of motion and strength. When training for strength, the therapist can assist the user helping them reach further degrees of movement. The user would place his foot on the foot plate 112 and try to rotate the foot plate 112 (and base plate 114) counterclockwise forty five degrees until the indicator line reaches the 0 degree mark on the plate angle indicator 130. A second way to use the foot plate system is to begin terminal flicks, which can be done by moving the foot plate 112 clockwise or counterclockwise 5-10 degrees with respect to the base plate frame 116, and having the user turn the foot plate 112 back and forth very quickly from the 5-10 degrees mark back and forth to the 0 degree mark. This can cause the user to quickly interchange concentric to eccentric contractions to improve motor control function to the muscles. Various resistance tubing can be used to provide different resistances as needed for the different exercises.

The foot plate system 110 can be used in a standing or sitting position. In some exemplary embodiments, when the user is in a sitting position, a knee support 140 can be provided to be used in conjunction with the foot plate system 110. The knee support 140 comprises a support bracket 142, which can have an adjustable height and depth on the exercise apparatus. Slots 148 can be provided on the support bracket 142 to work in conjunction with handles 146 to adjust for various knee widths. The handles can be loosened by turning the handles 146 counterclockwise to adjust the width, moving the handles 146 inward or outward along the width of the support bracket 142 as desired, then turning the handles 146 clockwise to tighten the handles 146. This can provide stabilization of the knee while the foot rotating exercises are performed. Handles 150 can be stationary at the ends of the support bracket 142, such that the knees fit between handles 150 and handles 146. In some exemplary embodiments, as shown in FIG. 3A, knobs 143 can be provided at the ends of handles 146 and 150 to secure them to the support bracket 142. In some exemplary embodiments, padding (e.g., foam) can be provided around the handles 146 and 150 to provide stabilization and comfort for the user.

In use, a user places their knees between the handles 146 and the padding 150 on the support bracket 142 when using the knee support 140 in a sitting position. The knee support 140 can keep the femur from adducting or abducting, and provide constant support and stability to the knees allowing a user to isolate internal and external support at the knee. By holding the knee in one place in a sitting position, the foot of the user is free to rotate in (inversion) or out (eversion), allowing a therapist to quickly identify compensations at the foot and ankle. The knee support 140 can help the user to train the kinetic chain to fire in a certain sequence which helps to reestablish the gate.

A quick release pin 158 allows you to move the knee attachment in a vertical plane and fits in corresponding holes in bracket 157, customizing to different leg heights with an attached lanyard allowing the user to easily adjust the height. Knob 156 allows tightening to bracket 157 to stabilize the support bracket 142. A quick release pin 154 allows you to move the support bracket 142 in a horizontal plane and fits in corresponding holes allowing for adjustment of the support bracket 142 in a horizontal plane, and knob 144 allows tightening to stabilize the support bracket 142.

In some exemplary embodiments, a twist bar 160 is provided for either individual exercises or joint exercises using the foot plate system 110. The twist bar 160 can have two opposing handles 162*a*, 162*b* for a user to grip. A knob 164 secures the twist bar 160 to the exercise apparatus 100, and allows the twist bar 160 to be raised, lowered and removed if desired. The ends 166*a*, 166*b* of the handles 162*a*, 162*b* have circular hooks that are connected to clips 168*a*, 168*b*. The clips 168*a*, 168*b* can be connected to resistance tubes 170*a*, 170*b*, and the other ends of the resistance tubes 170*a*, 170*b* are connected to clips 172*a*, 172*b*, which are secured to the exercise apparatus 100.

Figure 7:
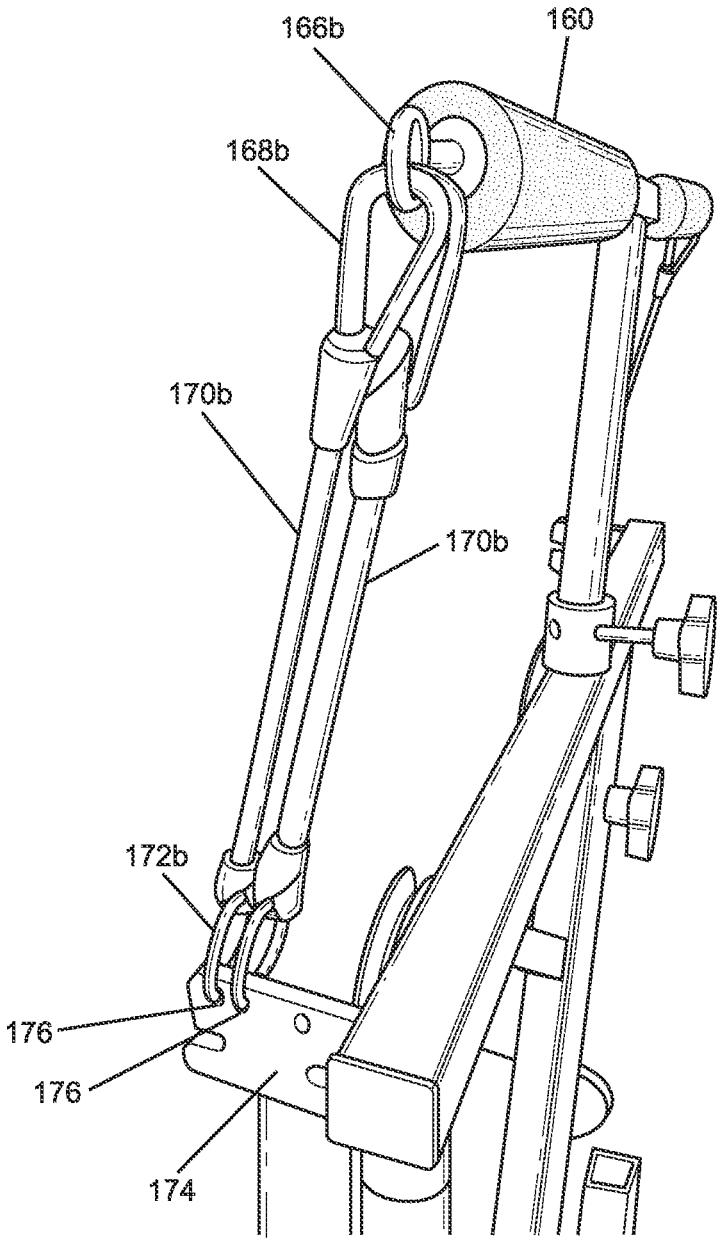
FIG. 7 illustrates a twist bar of the exercise apparatus according to an exemplary embodiment of the present disclosure.

As shown in FIG. 7, the resistance tubes 170*a*, 170*b* can be interchangeable, and more than one tube can be used (e.g., three tubes can be connected to clips 168*a*, 168*b* and clips 172*a*, 172*b*, and each tube can have the same or different resistances). For example, in some exemplary embodiments, a bracket 174 having one or more slots 176 can be mounted to the exercise apparatus 100. Each resistance tube 170*b* can be connected through a clip 172*b* to a slot 176. As shown in FIG. 7, two resistance tubes 170*b* are connected to two slots 176 of the bracket 174. Any number of slots can be provided on the bracket 174 and any number of resistance tubes can be used on either side of the twist bar 160, and the present disclosure is not limited to any number of slots on the bracket or number of type of resistance tubes.

Figure 7A:
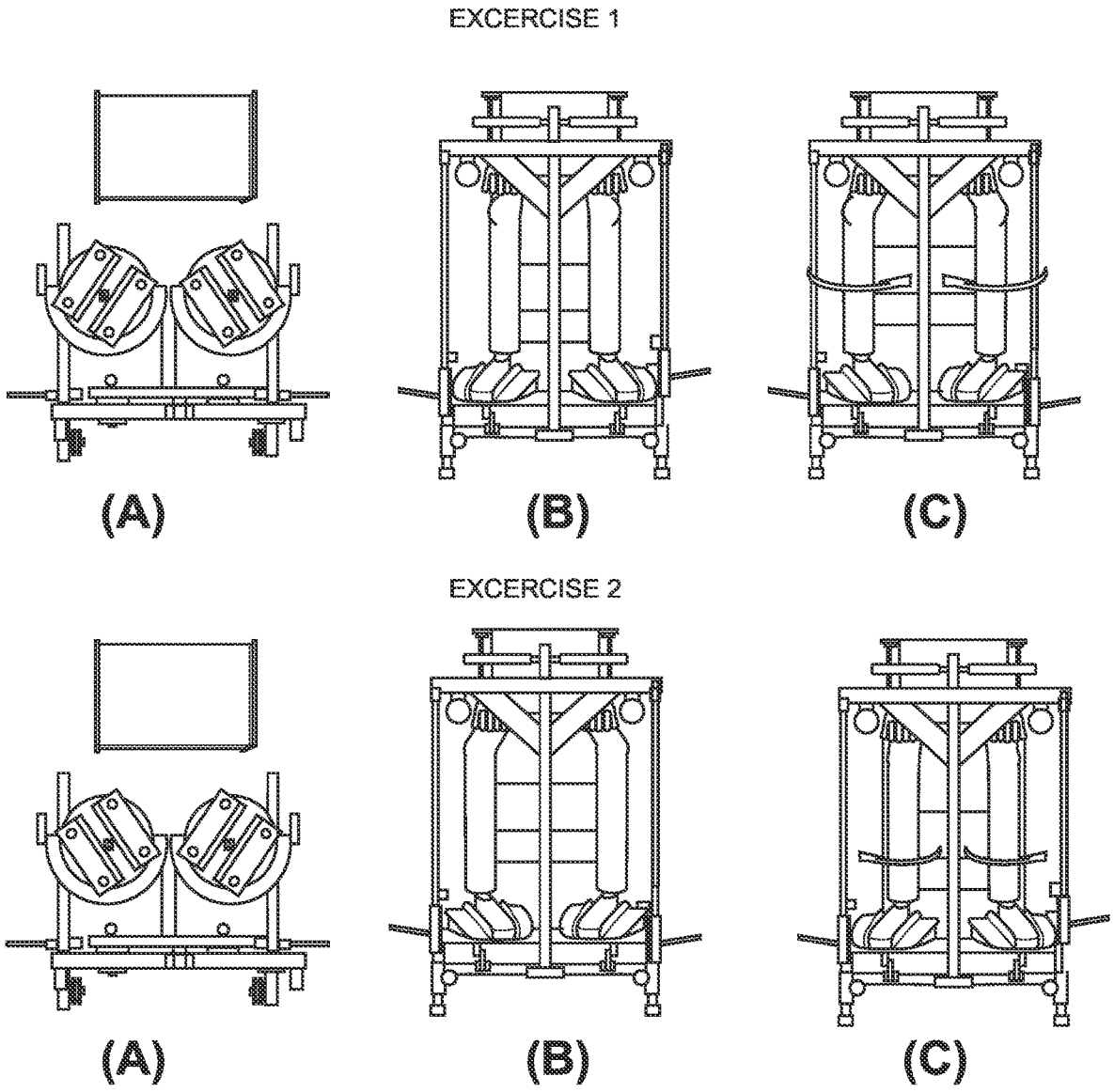
FIGS. 7A-7C illustrates various exercises that can be performed using the exercise apparatus according to the exemplary embodiments of the present disclosure.
Figure 7B:
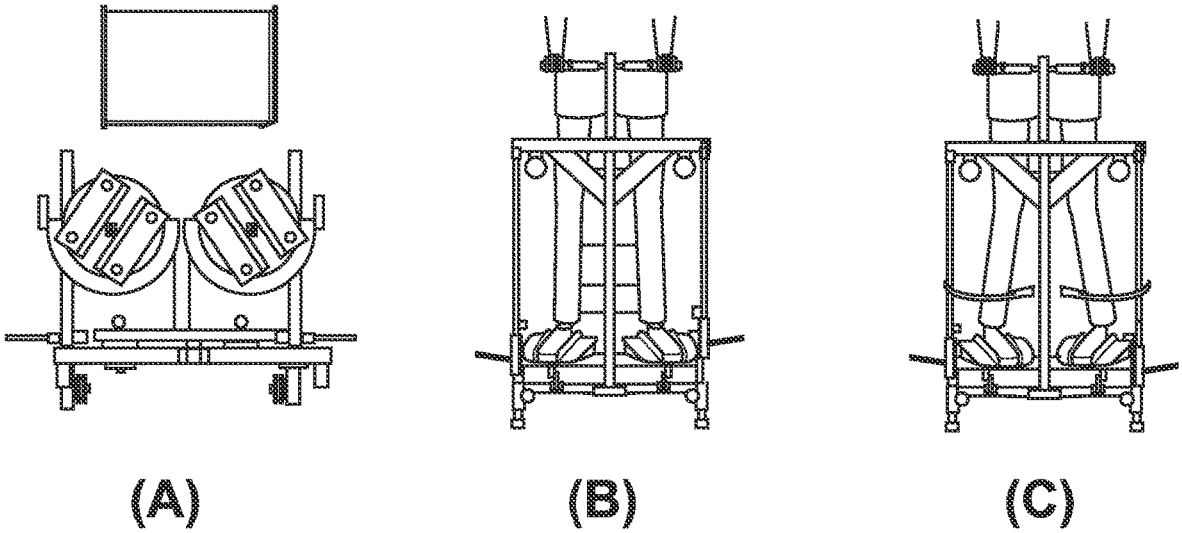
Figure 7B:
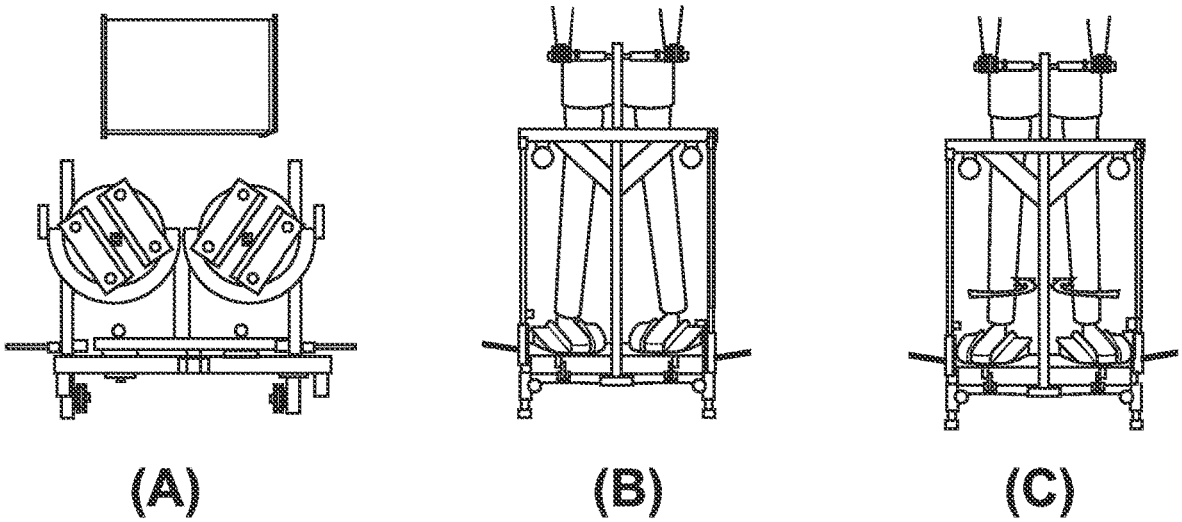
Figure 7C:
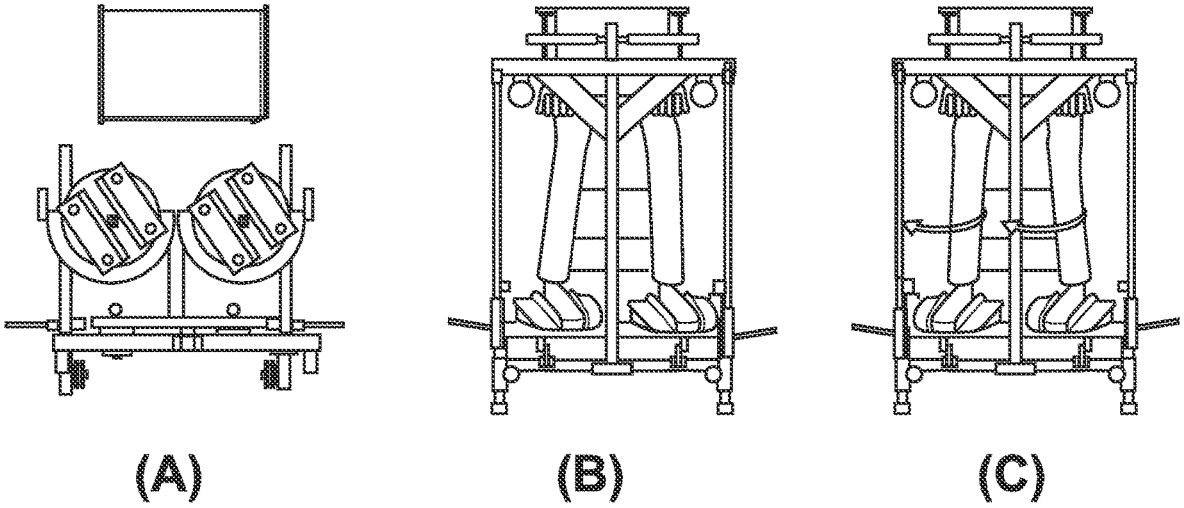
Figure 7C:
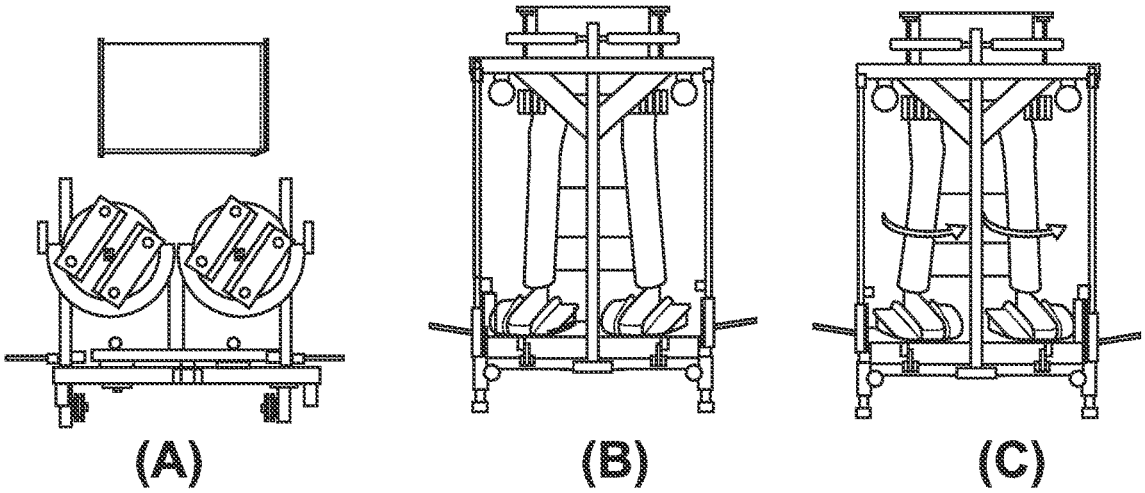

The twist bar 160 is designed to improve core stabilization and trunk rotation. It is also specifically designed to work with the foot plate system 110, and allows for different levels of resistance. The resistance bands provide light resistance for the beginner user and maximum resistance for the user who is stronger. The twist bar 160 trains for better trunk rotation to improve strength in the internal and external oblique and paraspinal muscles to help the trunk be more upright and also helps lateral movements. The twist bar 160 adds many unique training opportunities to the foot plate system 110 such as left hip stabilization. For example, when you rotate the left foot in you will load and strengthen your left adductors and left gluteus minimums, gluteus medias and TFL. When you rotate your right foot out you will load and strengthen the external rotator muscles of your right hip and femur. The resistance tubing on the ends of the twist bar 160 allow for the twist bar 160 to rotate with constant resistance, strengthening internal and external obliques and para spinal muscles. The twist bar 160 can extend upward providing more resistance and accommodating a taller individual. Various exercises can be performed using the exercise apparatus according to the exemplary embodiments of the present disclosure, as shown in, e.g., FIGS. 7A-7C. For example, in Exercise 1 for inner hamstrings, a user can sit with legs bent at a 90 degree angle with both feet pointing out (step A), can breathe in for 3 seconds (step B), and as they exhale, can turn both feet in as far as possible without using their inner thigh, then return slowly to the starting position and repeat, maintaining the 3 points of contact on the foot (step C). In Exercise 2 for outside hamstring and outside calf, a user can sit with legs bent at a 90 degree angle with both feet pointing in (step A), can breathe in for 3 seconds (step B), and as they exhale, can turn both feet out as far as possible without abducting their femur, then return slowly to the starting position and repeat, maintaining the 3 points of contact on the foot (step C). In Exercise 3 for outside hip and inner thigh, a user can stand and hold onto the handle bars and step on the foot plates one at a time with both feet pointing out (step A), can breathe in for 3 seconds (step B), and as they exhale, can maintain straight legs as they initiate rotation by simultaneously turning both feet inwards as far as possible and slowly return to the starting position and repeat (step C). In Exercise 4 for external hip rotators, a user can stand and hold onto the handle bars and step on the foot plates one at a time with both feet pointing in (step A), can breathe in for 3 seconds (step B), and as they exhale, can initiate rotation by simultaneously turning both feet outwards as far as possible and slowly return to the starting position and repeat (step C). In Exercise 5 for inner left hamstring and outside right hamstring, a user can sit with legs bent at a 90 degree angle with left foot plate out and right foot plate in (step A), can breathe in for 3 seconds (step B), and as they exhale, can initiate rotation by simultaneously turning left foot plate in and their right foot plate out as far as possible and slowly return to the starting position and repeat (step C). In Exercise 6 for inner right hamstring and outside left hamstring, a user can sit with legs bent at a 90 degree angle with left foot plate in and right foot plate out (step A), can breathe in for 3 seconds (step B), and as they exhale, can initiate rotation by simultaneously turning left foot plate out and their right foot plate in and slowly return to the starting position and repeat (step C).

In some exemplary embodiments, a back pulley system 180 can be provided at a rear portion of the exercise apparatus 100 as shown in FIGS. **3*a*-4*b*. Pulleys 222 are provided on upper and lower portions where cable wires are provided through to which various handles can be provided for various exercises. One end of the cable wires can connect to foot plates 112, can run through the pulleys 222, and end at clips 224. The clips 224** can then connect to, e.g., ankle cuffs or handles where various exercises can be performed for the feet, arms and back.

Figure 8:
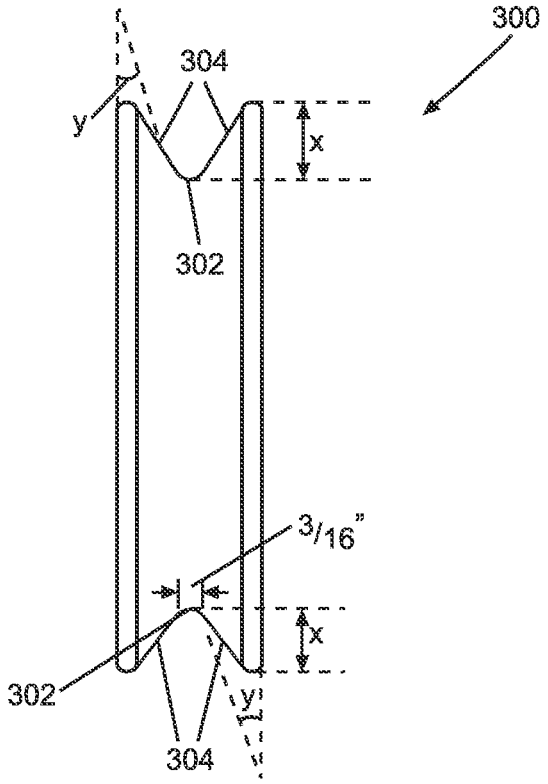
FIG. 8 illustrates a pulley of the exercise apparatus according to an exemplary embodiment of the present disclosure.

Each pulley (pulleys 22 and pulleys **204*a*, 204*b*, 206*a*, 206*b*) can be constructed as shown in FIG. 8. The pulley 300 can have side walls 304 that culminate in a valley 302 on both an upper end and a lower end as shown in FIG. 8. The side walls 304 are provided at an angle Y that can range from approximately 27 degrees to approximately 31 degrees, and can be approximately 29 degrees. The depth x of the valley 302 with respect to the top of the pulley 300 can range from approximately between 0.4 inches to approximately 0.6 inches, and can be approximately 0.5 inches. The flat or horizontal portion of the valley 302** is approximately 3/16 inches, which can allow a more secure fit with the cable wire.

This angle and depth can provide a novel pulley that is wider at a top portion. The angle can force a cable to stay on track within the pulley without drag friction on both sides, and can prevent a cable wire from slipping within the pulley. This angle and depth allow the cable wire to rest deep enough inside the pulley 300 so the cable wire will not constantly rub on the pulley 300. This can help to eliminate any drag or lag on the cable wires, and forces the cable wire to sit on the valley 302 with less drag and prevents slip.

Figure 9:
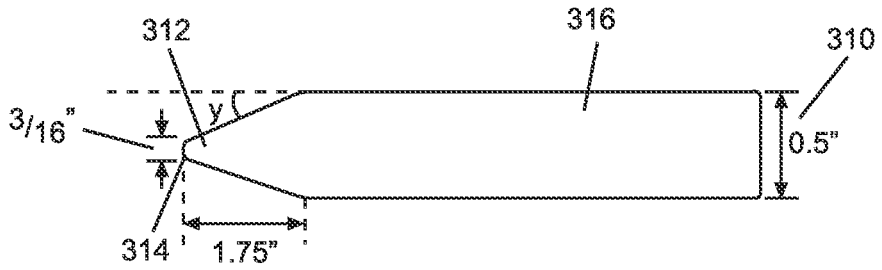
FIG. 9 illustrates a pulley tool of the exercise apparatus according to an exemplary embodiment of the present disclosure.

In order to construct the pulley 300 described above, a pulley tool 310 as shown in FIG. 9 can be provided having a body portion 316 and a top portion 312. The top portion 312 is used to create the depth and angle of the pulley 300 described above. The pulley tool can have a length of approximately 3 inches to approximately 4 inches, and can be 3.25 inches, and can have a bottom width of about 0.5 inches. The top portion 312 of the pulley tool 310 can have tapered walls that extend to a tip 314. The tapered walls are tapered at an angle Y that is approximately 27 degrees and approximately 31 degrees, and can be approximately 29 degrees, corresponding to the angle created for the pulley 300 described above. The length of the top portion can be approximately 1.75 inches. The tip 314 of the top portion 312 can have a width of approximately 3/16 inches, that creates the flat or horizontal portion of the valley 302 of the pulley 300 described above. The pulley tool 300 can be constructed of a high speed steel cobalt material.

Using the pulleys 300 described above, the back pulley system 180 can allow a user to train the upper body and lower body by using constant resistance through a short range of motion. A user is able to train flexion and extension of the hip as well as abduction and adduction of the hip. Adding resistance tubing to the pulleys 300 can provide constant resistance. The back pulley system 180 provides the ability to allow a user a total body workout.

Figure 10:
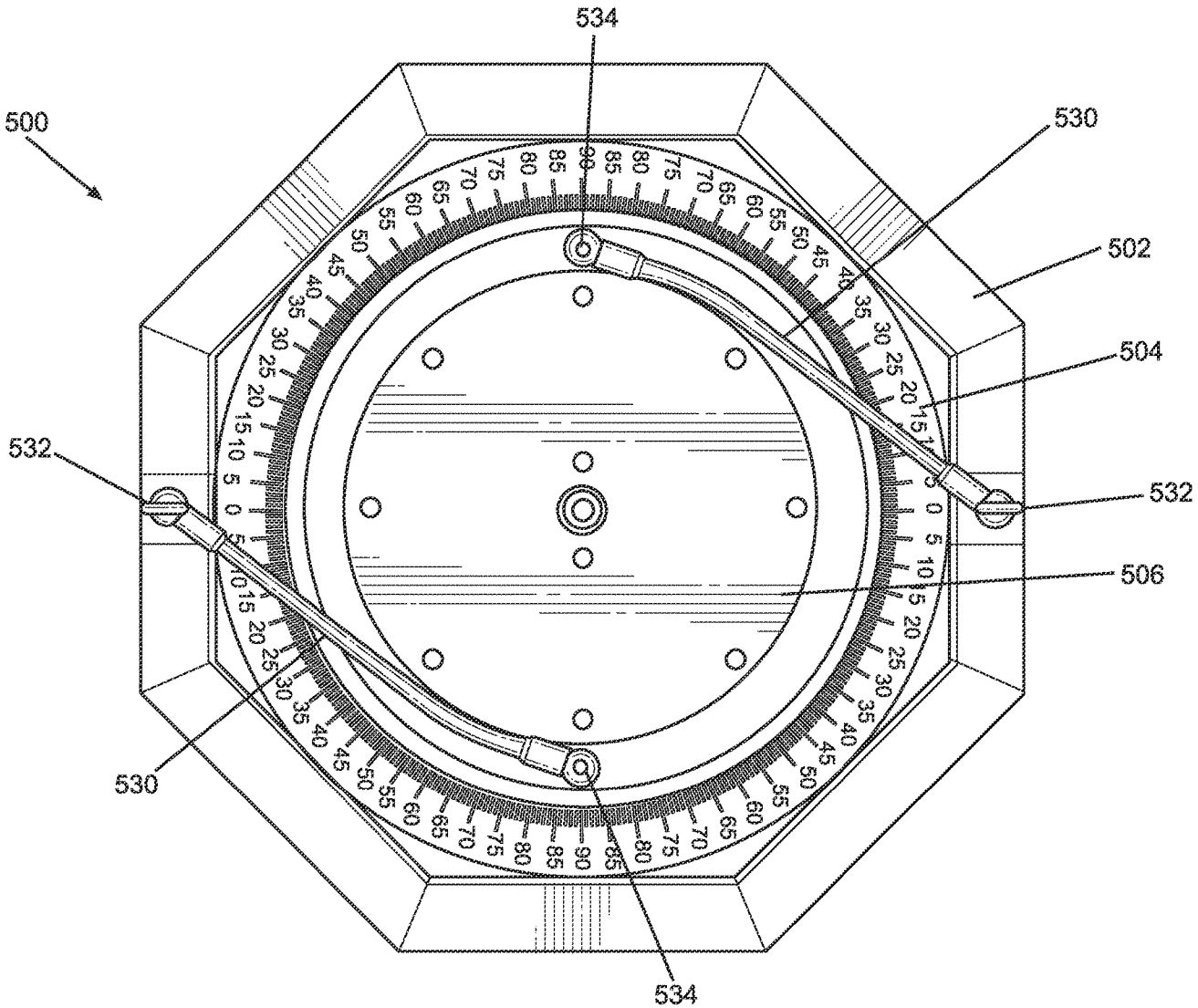
FIG. 10 is a top view of a portable exercise apparatus according to an exemplary embodiment of the present disclosure.
Figure 11:
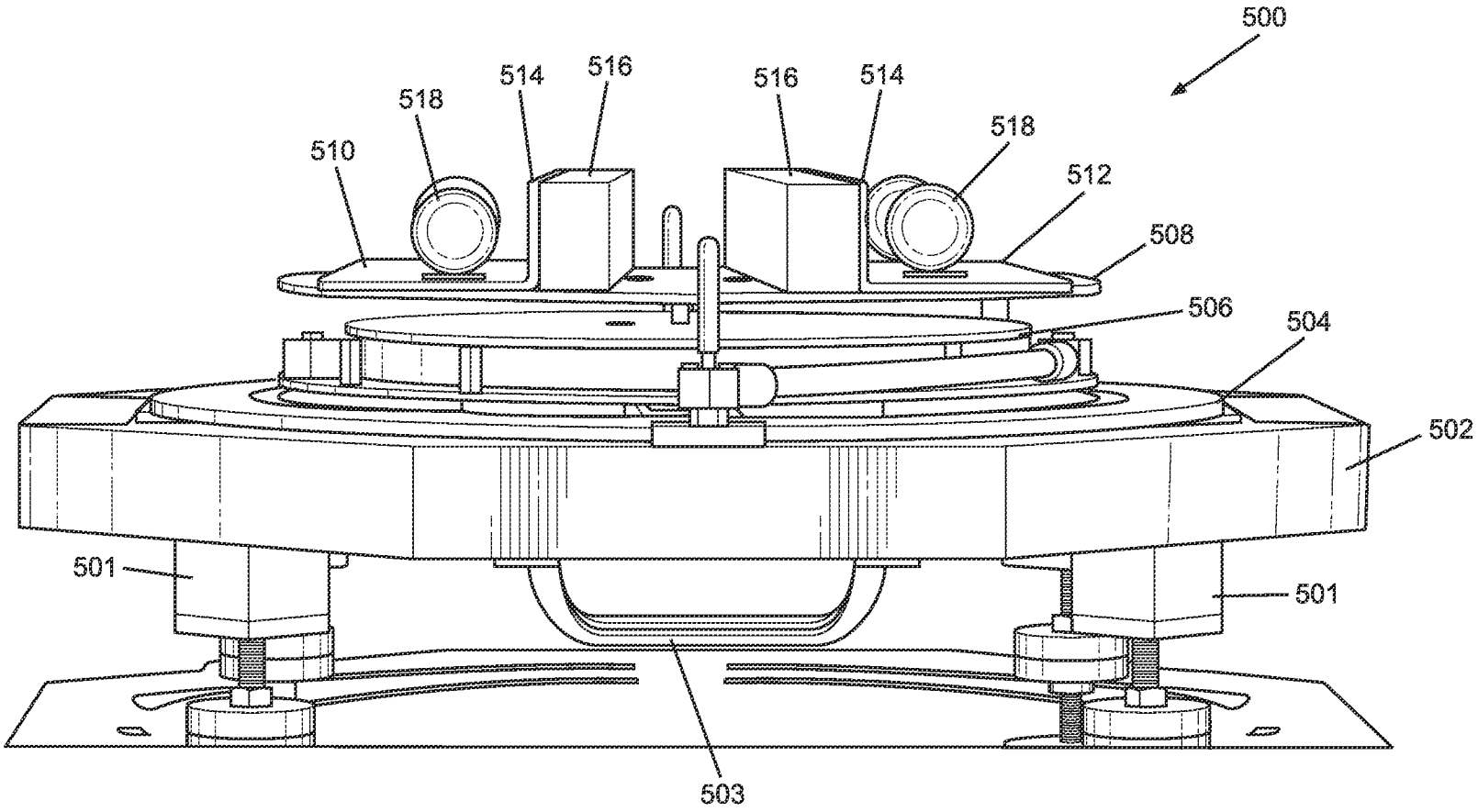
FIG. 11 is a side view of a portable exercise apparatus according to an exemplary embodiment of the present disclosure.

In some exemplary embodiments, as shown in FIGS. 10-11, a portable foot exercise apparatus 500 can be provided which can provide a portable version for users or trainers, which can allow for rotational training with resistance tubing for constant resistance. The portable apparatus 500 can have a frame 502 that sits on one or more stands 501, which can have foot levelers to allow for leveling of the portable apparatus when on uneven ground. A handle 503 can be provided on the bottom side for carrying the portable apparatus 500. An angle indicator plate 504 can be provided on top of the frame 502 that is stationary. A base plate 506 can be provided that rotates with respect to the frame 502 and angle plate 504. A foot plate 508 is provided above the base plate 506, and a left support plate 510 and right support plate 512 can be provided on the foot plate 508 having a similar structure to the left support plate 118 and right support plate 120 above with respect to the exercise apparatus 100.

For example, the portable apparatus 500 comprises a foot plate 508 which is provided on top of and secured to a base plate 506, such that the foot plate 508 and base plate 506 can rotate with respect to the angle plate 504 and the frame 502. A left support plate 510 and a right support plate 512 are provided on top of the foot plate 508. The left support plate 510 and right support plate 512 have a vertically extending wall 514. The left support plate 510 and right support plate 512 can have one or more slots through which threaded knobs 518 secure the left support plate 510 and right support plate 512 to the foot plate 508. Two vertically extending walls 514 are provided on each of the left support plate 510 and right support plate 512, such that a user's foot can be placed between the vertically extending walls 514 of the left support plate 510 and right support plate 512. In some exemplary embodiments, padding 516 such as foam can be provided inward of the vertically extending walls 514 such that a user can place his foot between the padding 516 of the vertically extending walls 514 of the left support plate 510 and the right support plate 512. When a user turns his foot on the foot plate 508, the foot plate 508, left support plate 510 and right support plate 512, base plate 506 all turn in the same direction with respect to the angle plate 504 and frame 502.

The angle indicator plate 504 can allow a user (or therapist and user) to measure a user's range of motion. Similar as in the exercise apparatus 100, a locking mechanism is provided between the foot plate 508 and base plate 506 such that a user can lift the foot plate 508 off of the base plate 506, and turn the foot plate 508 to a desired degree, which angle can be shown on the angle indicator plate 504. Then, the user can release the foot plate 508, which would then lock the foot plate 508 to the base plate 506 at that location. In some exemplary embodiments, the foot plate 508 can be locked at 45 degree intervals in the clockwise and counterclockwise direction on the base plate 506. Similar to the exercise apparatus 100, the bottom portion of the foot plate 508 can have a tapered pin 520 that corresponds to a hole in the base plate 506 to secure the foot plate 508 to the base plate 506. In some exemplary embodiments, a strap (not shown) can be provided over the padding 516 and connected between the left support plate 510 and right support plate 512 to allow a user to pick up his foot and lift the foot plate 508 from the base plate 506.

In some exemplary embodiments, eight holes can be provided on the surface of the base plate 506 around the circumference of the base plate 506 at an equal distance from each other that correspond to a desired position of the tapered pin 520, such that a user can lift the foot plate 508 off the base plate 506 to release the tapered pin 520 from the base plate 506. Then, the user can rotate the foot plate 508 at any 45 degree interval (in either direction) and place the tapered pin 520 into one of the eight holes on the base plate 506, to lock and secure the foot plate 508 onto the base plate 506. More or less holes can be provided on the base plate 506 to provide more positions of the foot plate 508 on the base plate 506 (e.g., 12 holes at 30 degree intervals), and the exemplary embodiments are not limited by any number of holes on the base plate 506.

Resistance tubing 530 can be provided on the portable apparatus 500 to provide resistance for training. In some exemplary embodiments, two resistance tubes 530 can be provided that connect to an eyelet 532 on the frame 502 at one end of the resistance tube 530. The second opposite end of the resistance tube can be connected to a pin 534 on the base plate 506. Any number of pins 534 can be provided on the base plate 506 that can provide for greater or less resistance of the resistance tubes 530 based on a stretched length of the resistance tubes 530. For example, additional pins 534 can provide for a greater or lesser length which can make the resistance greater or lesser. The resistance tubes 530 can provide constant resistance for inversion/internal knee rotation and eversion/external knee rotation, and the user can move the foot plate 508 (and base plate 506) in a clockwise or counterclockwise direction. Various resistance tubes 530 can be provided that can also provide for greater or lesser levels of resistance tubing. This can allow a person to progress from light resistance to heavy resistance as needed. The apparatus 500 can be used alone or in conjunction with another apparatus 500 for both feet together. It can be used in a sitting position (which can train the foot, ankle and knee) or in a standing position (which can train the hamstrings, IT band, adductors, hip and core).

Various other considerations can also be addressed in the exemplary applications described according to the exemplary embodiments of the present disclosure. For example, various materials may be used to construct the elements described in the figures. Various sizes and dimensions of the exercise apparatus 100 and exercise apparatus 500 and the parts thereof can be provided. Multiple variations of the pulleys 300 can be provided on the back pulley system 180 and on the exercise apparatus 100 to provide for various exercises and training. In some exemplary embodiments, as shown in FIG. 1, the exercise apparatus 100 can have a connected display 400 through a bracket that can be connected to the exercise apparatus 100 at a first end and the display 400 at a second end. A knob 404 can provide for vertical adjustment of the display 400 for various users. The display can provide exercise information and data on the user's workout. Sensors can be provided on the foot plate system 110, twist bar 160 and back pulley system 180 which can provide various data on the display 400. The sensors can measure resistance and strength in rotational range of motion for the user and trainer. Weighted foot plates 112 can provide data on the display as to how much weight the user is putting on each foot and which foot is taking more stress. Sensors on the twist bar 160 can advise the user how many degrees of trunk rotation they moved. Cameras can be provided to record the user's workout on the various devices of the exercise apparatus.

Various advantages can be provided based on the exemplary embodiments described above. For example, the exercise apparatus can allow a user to have an understanding on how to assess, test, analyze and strength train in rotation. A user can quickly achieve the desired strengthening or rehabilitation result they are looking for. The exercise apparatus incorporates the concepts of assessing posture and gait, and a trainer can assist a user in identifying muscle compensations that can occur in the body while training on the exercise apparatus. A trainer can teach specific stretches and muscle release techniques to reorganize fascia and reduce muscle tension. Breathing techniques can be incorporated to oxygenate the muscles and to enhance each training session.

Following the muscle stretching and tissue release, a user can be taught to strength train on the exercise apparatus. Constant resistance provided can keep the brain engaged through the exercises, and key muscles can be strengthened around various body parts, such as the ankle, knee, hip and trunk.

The words "ranging", "ranges from", "ranges between" and other similar notations, are used herein interchangeably and are meant to include the first and second indicated numbers and all the fractional and integral numerals there between. It should be noted that where various embodiments are described by using a given range, the range is given as such merely for convenience and brevity and should not be construed as an inflexible limitation on the scope of the disclosure. Accordingly, the description of a range should be considered to have specifically disclosed all the possible sub-ranges as well as individual numerical values within that range.

The foregoing merely illustrates the principles of the disclosure. Various modifications and alterations to the described embodiments will be apparent to those skilled in the art in view of the teachings herein. It will thus be appreciated that those skilled in the art will be able to devise numerous systems, arrangements, manufacture and methods which, although not explicitly shown or described herein, embody the principles of the disclosure and are thus within the spirit and scope of the disclosure.

What is claimed is:

1. An exercise apparatus, comprising:

a base frame;

a base plate provided on the base frame, the base plate including a plurality of holes on a top surface of the base plate and configured to rotate with respect to the base frame; and a foot plate provided on the base plate, the foot plate including a tapered pin on a bottom surface of the foot plate that can engage with one of the plurality of holes of the base plate; wherein the tapered pin is tapered at an angle of approximately three degrees to approximately five degrees; and wherein when the tapered pin is engaged to the one of the plurality of holes of the base plate, the foot plate and base plate are configured to rotate with respect to the base frame.

2. The exercise apparatus of claim 1, further comprising:

a plate angle indicator provided on the base frame that provides an angle that the foot plate and base plate are rotated with respect to the base frame.

3. The exercise apparatus of claim 1, further comprising:

a first support plate provided on the foot plate and having a first wall extending upward from the foot plate; and a second support plate provided on the foot plate and having a second wall extending upward from the foot plate;

wherein a user's foot can be placed between the first wall and the second wall.

4. The exercise apparatus of claim 3, wherein the first support plate and the second support plate include slots.

5. The exercise apparatus of claim 4, further comprising:

one or more threaded knobs provided through the slots to secure the first support plate and second support plate to the foot plate.

6. The exercise apparatus of claim 3, further comprising:

padding secured to an inner portion of the first wall and the second wall.

7. The exercise apparatus of claim 1, further comprising:

a rod secured to the bottom surface of the foot plate and secured to the base frame, wherein the rod passes through the base plate and allows the foot plate to rotate with respect to the base frame.

8. The exercise apparatus of claim 1, wherein the tapered pin is tapered at an angle of approximately three degrees.

9. The exercise apparatus of claim 1, further comprising:

a resistance system connected to the foot plate to provide resistance to the base plate and foot plate when rotated with respect to the base frame.

10. The exercise apparatus of claim 9, wherein the resistance system comprises one or more resistance tubes.

11. The exercise apparatus of claim 10, further comprising:

a twist bar secured to a pole extending upward from the base frame and having two handles that connect to the resistance system.

12. The exercise apparatus of claim 10, further comprising:

a pulley system connected to the exercise apparatus and the resistance system.

13. The exercise apparatus of claim 1, wherein the foot plate is configured to disengage from the base plate when a foot of a user that is placed on the foot plate is lifted such that the user can then rotate the foot plate with respect to the base plate.

14. The exercise apparatus of claim 1, further comprising:

a knee support connected to the exercise apparatus for providing support for knees of a user when using the exercise apparatus.

15. The exercise apparatus of claim 1, further comprising:

a handle connected underneath the base frame for providing portability of the exercise apparatus.

16. The exercise apparatus of claim 1, wherein the plurality of holes comprise eight holes provided equidistant from each other on the top surface of the base plate.

17. The exercise apparatus of claim 1, further comprising:

one or more eyelets connected to the base frame for connecting a first end of one or more resistance tubes to the base plate.

18. The exercise apparatus of claim 17, further comprising:

one or more pins provided on the base plate for connecting a second end of the one or more resistance tubes.

19. The exercise apparatus of claim 1, wherein the base plate and foot plate can be rotated clockwise or counterclockwise with respect to the base frame.

20. The exercise apparatus of claim 1, further comprising:

a second base plate provided on and secured to the base frame, the second base plate including a plurality of holes on a top surface of the second base plate and configured to rotate with respect to the base frame;

a second foot plate provided on the second base plate, the second foot plate including a second tapered pin on a bottom surface of the second foot plate that can engage with one of the plurality of holes of the second base plate;

wherein when the second tapered pin is engaged to the one of the plurality of holes of the second base plate, the second foot plate and the second base plate are configured to rotate with respect to the base frame.

* * * * *